US007260901B2

(12) United States Patent
Doll

(10) Patent No.: US 7,260,901 B2
(45) Date of Patent: Aug. 28, 2007

(54) DEVICE FOR CONTROLLING THE TEMPERATURE OF OBJECTS

(75) Inventor: Martin Doll, Weil im Schoenbuch (DE)

(73) Assignee: Eisenmann Maschinenbau GmbH & Co. KG (DE)

( * ) Notice: Subject to any disclaimer, the term of this patent is extended or adjusted under 35 U.S.C. 154(b) by 0 days.

(21) Appl. No.: 10/521,337

(22) PCT Filed: Jun. 18, 2003

(86) PCT No.: PCT/EP03/06401

§ 371 (c)(1),
(2), (4) Date: Mar. 28, 2005

(87) PCT Pub. No.: WO2004/010066

PCT Pub. Date: Jan. 29, 2004

(65) Prior Publication Data

US 2006/0055091 A1 Mar. 16, 2006

(30) Foreign Application Priority Data

Jul. 18, 2002 (DE) ..... 102 32 529

(51) Int. Cl.
*F26B 3/00* (2006.01)
*F26B 21/02* (2006.01)

(52) U.S. Cl. ..... 34/500; 34/428; 34/429; 34/566; 34/571; 34/210; 34/217

(58) Field of Classification Search ..... 34/272, 34/270, 271, 428, 429–435, 438, 500, 501, 34/502, 545, 566, 570, 571, 209, 210, 217
See application file for complete search history.

(56) References Cited

U.S. PATENT DOCUMENTS

| | | | | |
|---|---|---|---|---|
| 4,663,863 | A * | 5/1987 | Curry et al. | 34/566 |
| 4,761,894 | A | 8/1988 | Hamasaki et al. | 34/39 |
| 4,873,107 | A * | 10/1989 | Archer | 426/520 |
| 5,557,858 | A * | 9/1996 | Macaluso et al. | 34/273 |
| 5,743,962 | A | 4/1998 | Ogasawara et al. | 118/643 |
| 5,958,330 | A | 9/1999 | Westman | 266/252 |
| 2002/0056710 | A1 | 5/2002 | Rehm | 219/388 |

FOREIGN PATENT DOCUMENTS

| | | |
|---|---|---|
| DE | 2114194 | 10/1971 |
| DE | 3941134 | 6/1991 |

OTHER PUBLICATIONS

International Search Report dated Oct. 10, 2003.

* cited by examiner

*Primary Examiner*—Kenneth Rinehart
(74) *Attorney, Agent, or Firm*—Young Basile

(57) ABSTRACT

The invention relates to a device for controlling the temperature of objects, especially for drying or cooling objects, said device comprising a housing containing at least two tempering units which are arranged in a functionally parallel manner. Each tempering unit comprises a tunnel-type usable space in which tempered air is applied to the objects. Said objects can be displaced through the usable spaces by means of a respective transport system. According to the invention, the at least two tempering units are superimposed in the housing essentially above the same base surface.

17 Claims, 5 Drawing Sheets

DEVICE FOR CONTROLLING THE TEMPERATURE OF OBJECTS

BACKGROUND OF THE INVENTION

The invention relates to an apparatus for thermally conditioning objects, in particular vehicle bodies, comprising a housing;

at least two thermally conditioning facilities which are arranged parallel in their operation, are accommodated in the housing and each comprise ba) a tunnel-like useful space, in which the objects can be impinged by thermally conditioned air;

bb) a conveying system, by which the objects can be moved through the useful space.

The term "thermally conditioning" is used in the present case as a generic term for all ways in which the temperature of the air by which objects are to be impinged is adjusted to a specific value. Thus, "thermally conditioning" can mean, for example, "heating", which is of importance particularly when the apparatus is designed as a drier. However, "thermally conditioning" can also be "cooling" if the objects are to be brought to a lower temperature.

Apparatuses of the type mentioned at the outset are known from the market in the automotive industry, where painted vehicle bodies or body components are to be dried or cooled. To increase the drying or cooling capacity, a plurality of parallel-arranged thermally conditioning facilities, i.e. drying or cooling facilities, are frequently employed, these being guided either in each case as "individual tubes" through separate housings or, lying one beside the other, through one and the same housing. However, the space requirement of these known apparatuses is relatively high.

SUMMARY OF THE INVENTION

The object of the present invention is to configure an apparatus of the type mentioned at the outset such that it better meets the constructional conditions at the place where it is to be installed.

This object is achieved according to the invention in that the at least two thermally conditioning devices are arranged one above the other in the housing, substantially over the same floor area.

With the present invention it is recognised that the "valuable commodity" at the place of installation of the apparatus is less the constructional height than the floor area. By arranging, in accordance with the invention, the thermally conditioning facilities not one beside but one above the other in the housing, floor area is saved for a given throughput. The arrangement of the plurality of thermally conditioning facilities one above the other additionally enables the operating principle of the so-called "A-lock", which is already employed in known driers, to be utilised or enhanced.

Particularly simple constructionally is that configuration of the invention in which the air path on which the thermally conditioned air flows to a first thermally conditioning facility leads through a second thermally conditioning facility. It is thus possible to save on air ducts, since part of the air path to the first thermally conditioning facility is provided by the second thermally conditioning facility.

If a permanent air connection exists between the at least two thermally conditioning facilities, both thermally conditioning facilities must always be operated simultaneously and in parallel. Adaptation to the particular temperature demand, i.e. a change of the capacity of the apparatus, is permitted by that configuration of the invention in which there is provided in the air path a device by which the passage of thermally conditioned air from the second thermally conditioning facility into the first thermally conditioning facility can be interrupted if required. This apparatus can therefore be run at two different capacities: at a larger capacity, in the case of which both thermally conditioning facilities are in operation, and at a smaller capacity, which corresponds to the capacity of that, second thermally conditioning facility through which the air path leads first of all.

In the simplest case, the connection in question can be interrupted manually by an appropriate part which is inserted into the air path. For example, a grating, through which the air flows from the second thermally conditioning facility into the first thermally conditioning facility, can be manually exchanged for a closed metal plate.

It is more convenient if the device for interrupting the air path is a controllable flap or a closable louvre.

If the at least two thermally conditioning facilities at least regionally divide the air path on which the air is discharged from the useful spaces, again a reduction of the outlay on apparatus, in particular of the air ducts required, is possible.

Even greater operating flexibility is permitted by an exemplary embodiment of the invention in which the air path on which the thermally conditioned air flows to the first thermally conditioning facility is independent of the air path on which the thermally conditioned air flows to the second thermally conditioning facility. For then it is possible to run the apparatus either at the total capacity of all the individual thermally conditioning facilities, at the capacity of part of the thermally conditioning facilities or else with each thermally conditioning facility individually.

As already mentioned above, the apparatus can be designed as a drier; it then has at least one heating unit for thermally conditioning the air.

It is particularly preferable if the drier according to the invention has the same number of heating units as there are drying facilities. If individual drying facilities within the whole drier are then shut down, a corresponding number of heating units can likewise be stopped, this being associated with considerable energy savings. Moreover, it is possible to use different air temperatures in the different drying facilities within the same drier.

As likewise already mentioned above, the apparatus according to the invention can also be designed as a cooler. In this case, at least one fan is provided, which sucks in fresh air and introduces it as thermally conditioned air into the useful spaces of the cooling facilities. If the cooling effect of the air of the outside atmosphere is not sufficient, at least one cooling unit, which cools the air introduced into the useful spaces of the cooling facilities, can be additionally provided.

BRIEF DESCRIPTION OF THE DRAWINGS

Exemplary embodiments of the invention are explained in more detail below with reference to the drawing, in which.

DETAILED DESCRIPTION OF THE PREFERRED EMBODIMENT

Figure 1:
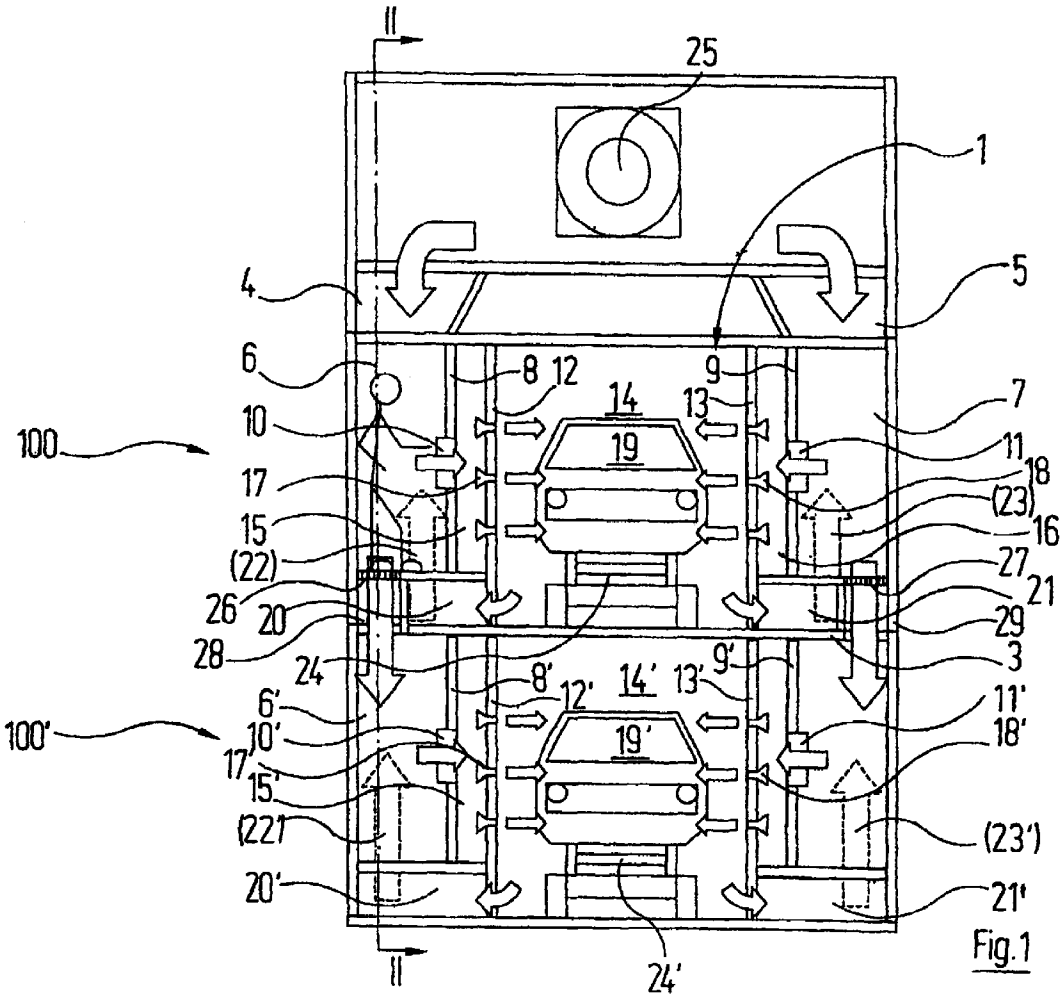
FIG. 1 shows a vertical section, taken perpendicularly to the movement direction of the objects to be dried, through a drier according to the invention, which is valid both for the exemplary embodiment of FIG. 2 and that of FIG. 3.
Figure 2:
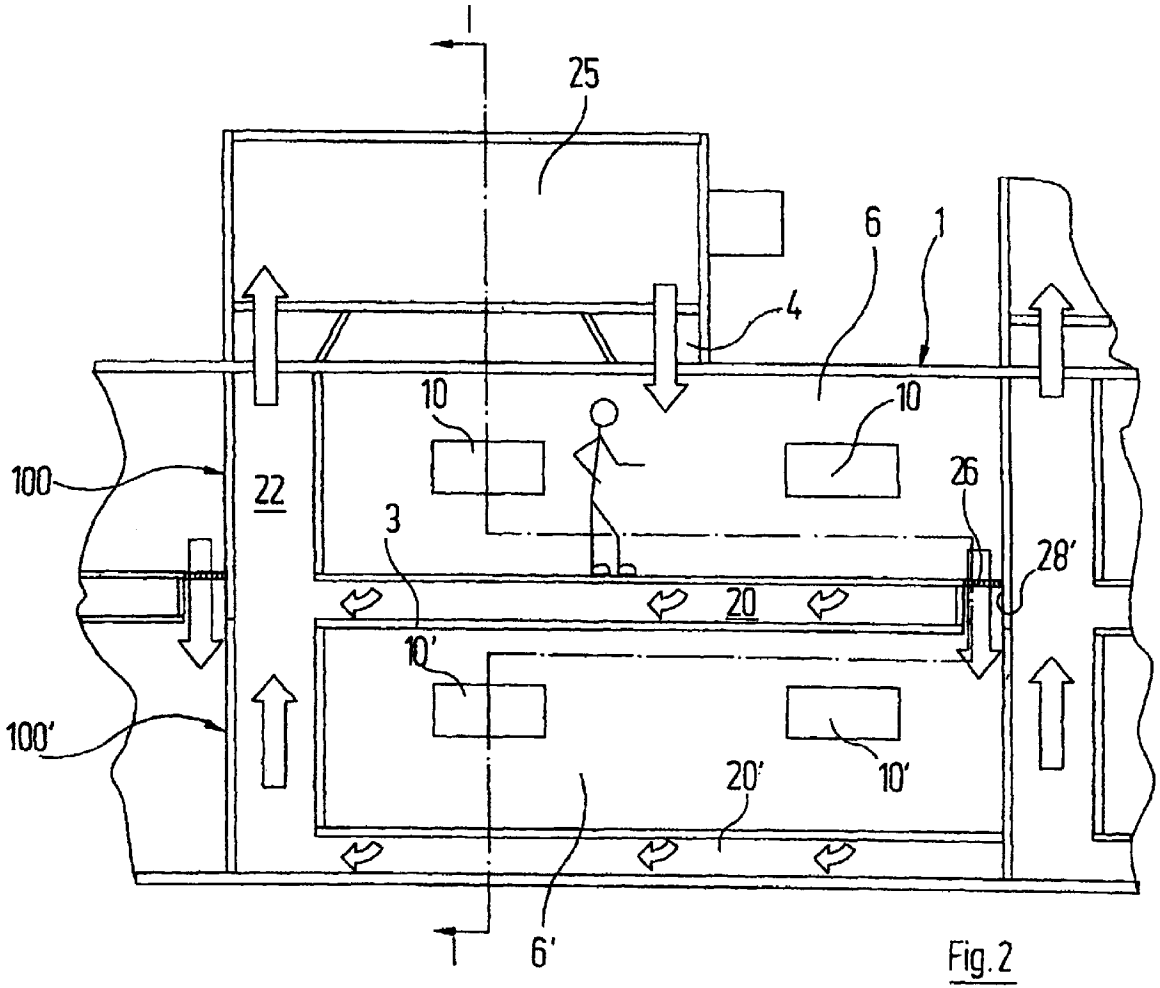
FIG. 2 shows a section according to line II-II of FIG. 1 through a first exemplary embodiment of a drier according to the invention.

Reference is made first of all to FIGS. 1 and 2 which together illustrate a first exemplary embodiment of a drier. The drier comprises a housing 1 which is subdivided by a horizontal intermediate ceiling 3 into two "storeys".

Arranged above the housing 1 is a circulating-air heating unit 25. The air heated by the latter passes via lateral connecting ducts 4, 5 into the upper "storey" of the housing 1 and there respectively into a pressure space 6, 7, adjacent to the lateral outer wall, of a first drying facility provided as a whole with the reference symbol 100. The pressure spaces 6, 7 are bounded inwards by a vertical partition wall 8, 9, in which openings provided with filters 10, 11 are situated. For maintenance of the filters 10, 11 or cleaning of the pressure spaces 6, 7, the latter can be accessed, as indicated schematically in the left-hand pressure space 6.

Formed between the vertical partition walls 8, 9 and the vertical, lateral boundary walls 12, 13 of the useful space 14 of the drying facility 100 is respectively an air distribution space 15 and 16. The heated air passes from the air distribution spaces 15, 16 via nozzles 17, 18 in the side walls 12, 13 into a tunnel-like useful space 14 and impinges there, as indicated by the arrows, on an object to be dried, in the example illustrated a freshly painted vehicle body 19.

The heated air is then sucked out of the useful space 14 via floor ducts 20, 21 provided with adjustable suction openings and passes back to the circulating-air heating unit 25 via vertical connecting ducts 22, 23 provided on both sides of the housing 1. The circulating-air circuit through the drying facility is thus completed. The connecting ducts 22, 23 cannot be seen directly in FIG. 1 as they are hidden by the pressure spaces 6 and 7, and are merely symbolically indicated by the dashed, upward-pointing arrows.

The objects 19 to be dried are transported through the drying facility 100, accommodated in the upper "storey" of the housing 1, perpendicularly to the plane of projection of FIG. 1 with the aid of a conveying device 24.

An almost completely identical drying facility 100' is situated beneath the first drying facility 100 in the lower "storey" of the housing 1. This drying facility 100' likewise comprises a useful space 14' with side walls 12', 13' which bound air distribution spaces 15', 16' inwards. The air distribution spaces 15', 16' are connected to the useful space 14' via nozzles 17', 18'. Lying outside the air distribution spaces 15', 16', separated from the latter by vertical partition walls 8', 9', are pressure spaces 6', 7', from which hot air can pass through filters 10', 11' in the partition walls 8', 9' into the air distribution spaces 15', 16'. The heated air is sucked out of the useful space 14' via floor ducts 20', 21' and passes from there into the same vertical connecting ducts 22, 23 which have already been described above for the drying facility 100 arranged in the upper "storey".

Whereas in the drying facility 100 situated in the upper "storey" the hot air is fed into the pressure spaces 6, 7 by the circulating-air heating unit 25 directly or via the connecting ducts 4, 5, hot air is fed into the pressure spaces 6', 7' of the lower drying facility 100' from the pressure spaces 6, 7 which are assigned to the upper "storey". Gratings 26, 27 are provided in the floors of the two upper pressure spaces 6, 7 for this purpose, via which gratings the hot air can pass into vertical connecting ducts 28, 29, lying to the side of the floor ducts 20, 21, and into the pressure spaces 6', 7' belonging to the lower "storey".

As FIG. 2 makes clear, what has been described above is only a segment of a complete drier. Further, substantially identically designed segments adjoin the illustrated segment on the left and right thereof in FIG. 2. At most, these segments differ substantially from the central segment in the temperature of the air introduced into the corresponding useful spaces. The conveying systems 24, 24' pass, of course, through all these segments from an inlet lock, arranged at one end of the drier housing, to an outlet lock arranged at the other end of the drier housing; both locks are not illustrated in FIG. 2 and fundamentally have a known construction, in particular that of an A-lock.

In the first exemplary embodiment of a drier described above with reference to FIGS. 1 and 2, the drying facilities 100, 100' situated in the lower and the upper "storey" of the housing 1 are preferably operated simultaneously. In order to enable the drying facility 100' situated in the lower "storey" to be switched off in the case of a reduced capacity demand of the whole drier, the gratings 26, 27 are to be closed by, for example, manually insertable metal plates. In this case, the air output of the heating unit 25 is adapted to the reduced demand, for example using a frequency converter.

In a second exemplary embodiment, which is now described with reference to FIGS. 1 and 3, the adaptation to a lower drier capacity demand is effected in a different way. In the description of the first exemplary embodiment, FIG. 1 was to be understood as a section according to the line I-I of FIG. 2; it is now to be used, in the description of the second exemplary embodiment, as a section according to line I-I of FIG. 3.

Figure 3:
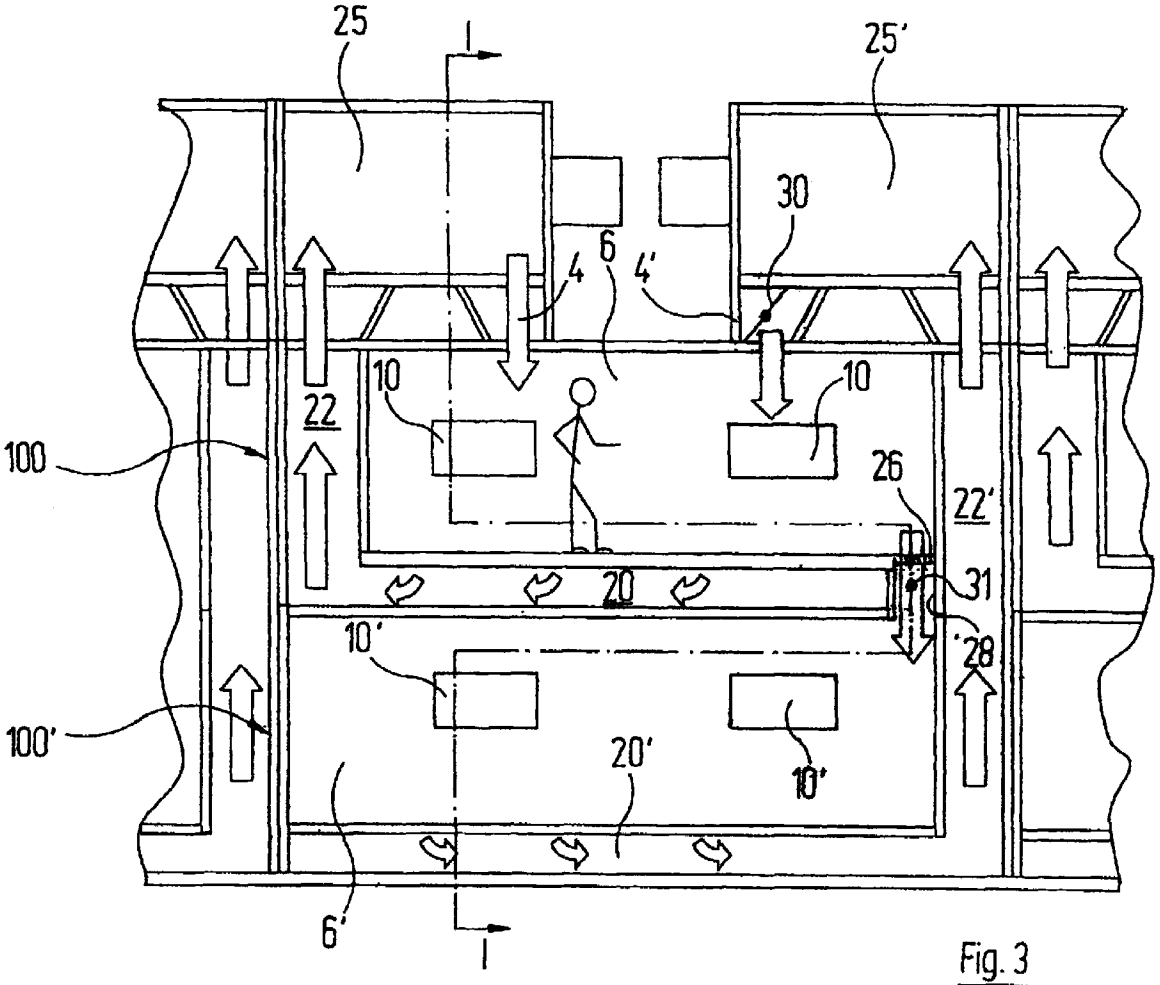
FIG. 3 shows a section according to line II-II of FIG. 1 through a second exemplary embodiment of a drier according to the invention.

The exemplary embodiment of FIG. 3 is very similar to that of FIG. 2; corresponding parts are therefore provided in FIG. 3 with the same reference symbols as in FIGS. 1 and 2. In order to enable the drying facility 100' situated in the lower "storey" of FIG. 3 to be switched off in the case of a reduced capacity demand of the whole drier, the following changes have been made compared with the exemplary embodiment of FIG. 2:

Two circulating-air heating units 25, 25' are now situated above the housing 1, each of which needs to have only half the air output of the heating unit 25 of the exemplary embodiment of FIG. 2. With the same air output, a doubling of the length of the housing 1 would be possible. Both heating units 25, 25' are connected via respective connecting ducts 4, 4' and 5, 5' to the pressure spaces 6, 7 on both sides of the upper useful space 14. Situated in the connecting duct 4' which is assigned to the circulating-air heating unit 25' on the right in FIG. 3 is a flap 30, by which this connecting duct 4' can be closed. The same applies correspondingly to the opposite connecting duct 5'. Correspondingly, further flaps 31 have been inserted into the connecting ducts 28, 29 which connect the upper pressure spaces 6, 7 to the lower pressure spaces 6', 7', by which flaps these connecting ducts 28, 29 can be closed if required.

In the exemplary embodiment of FIG. 3, the upper and lower floor ducts 20, 21, 20', 21' do not open into the same connecting duct. Rather, the drying facility 100 situated in the upper "storey" of the housing 1 has its own connecting ducts 22, 23 which lead upwards to the circulating-air heating unit 25 on the left in FIG. 3 and end at the level of the horizontal intermediate ceiling 3, while the floor ducts 20', 21' of the lower drying facility 100' open into their own vertically running connecting ducts 22', 23' which penetrate through the intermediate ceiling 3 and lead to the circulating-air heating unit 25' on the right in FIG. 3.

The exemplary embodiment illustrated in FIGS. 1 and 3 is operated as follows:

If the full capacity of the drier is required, both circulating-air heating units 25 and 25' are used. With the flap 30 open, both circulating-air heating units 25, 25' blow heated air into the lateral pressure spaces 6, 7 of the upper drying facility 100, part of which air circulates in the manner already described via the useful space 14 of the upper drying facility 100, is sucked out via the upper floor ducts 20, 21 and is led via the vertical connecting ducts 22, 23 to the first circulating-air heating unit 25 again. The other part of the hot air produced by the two circulating-air heating units 25, 25' passes through the gratings 26, 27 in the floor of the pressure spaces 6, 7 of the upper drying facility 100 into the two pressure spaces 6', 7' of the lower "storey", is circulated via the useful space 14' there for the purpose of drying the objects 19' there, is sucked out via the lower floor ducts 20', 21' and is led via the vertically running connecting ducts 22', 23' upwards to the second circulating-air heating unit 25'.

In contrast, if only a lower drier capacity is required, the drying facility 100' situated in the lower storey can be shut down as follows: the circulating-air heating unit 25' on the right in FIG. 3 is stopped; the flap 30 is closed, as is the flap 31'. The circulating-air heating unit 25 on the left in FIG. 3 remains in operation, however; the air heated by the latter is circulated solely via the upper useful space 14 and dries the objects 19 guided through this space.

Even greater operating flexibility than in the second exemplary embodiment is possible in the third exemplary embodiment of a drier which is described below with reference to FIGS. 4 and 5. This exemplary embodiment is likewise so similar to the above-described exemplary embodiments that the same reference symbols are used for corresponding parts.

Figure 4:
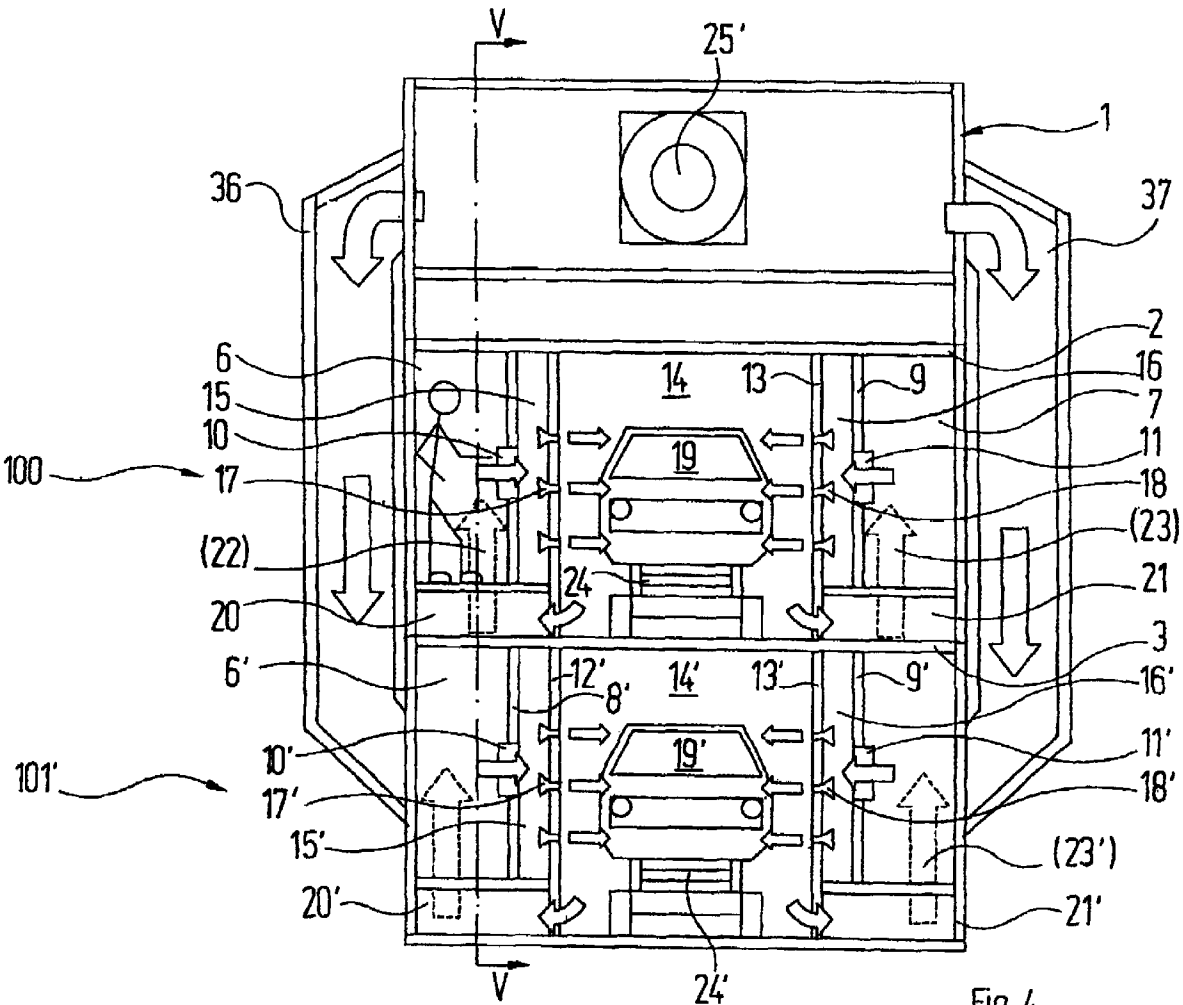
FIG. 4 shows a vertical section, similar to FIG. 1, through a third exemplary embodiment of a drier according to the invention.
Figure 5:
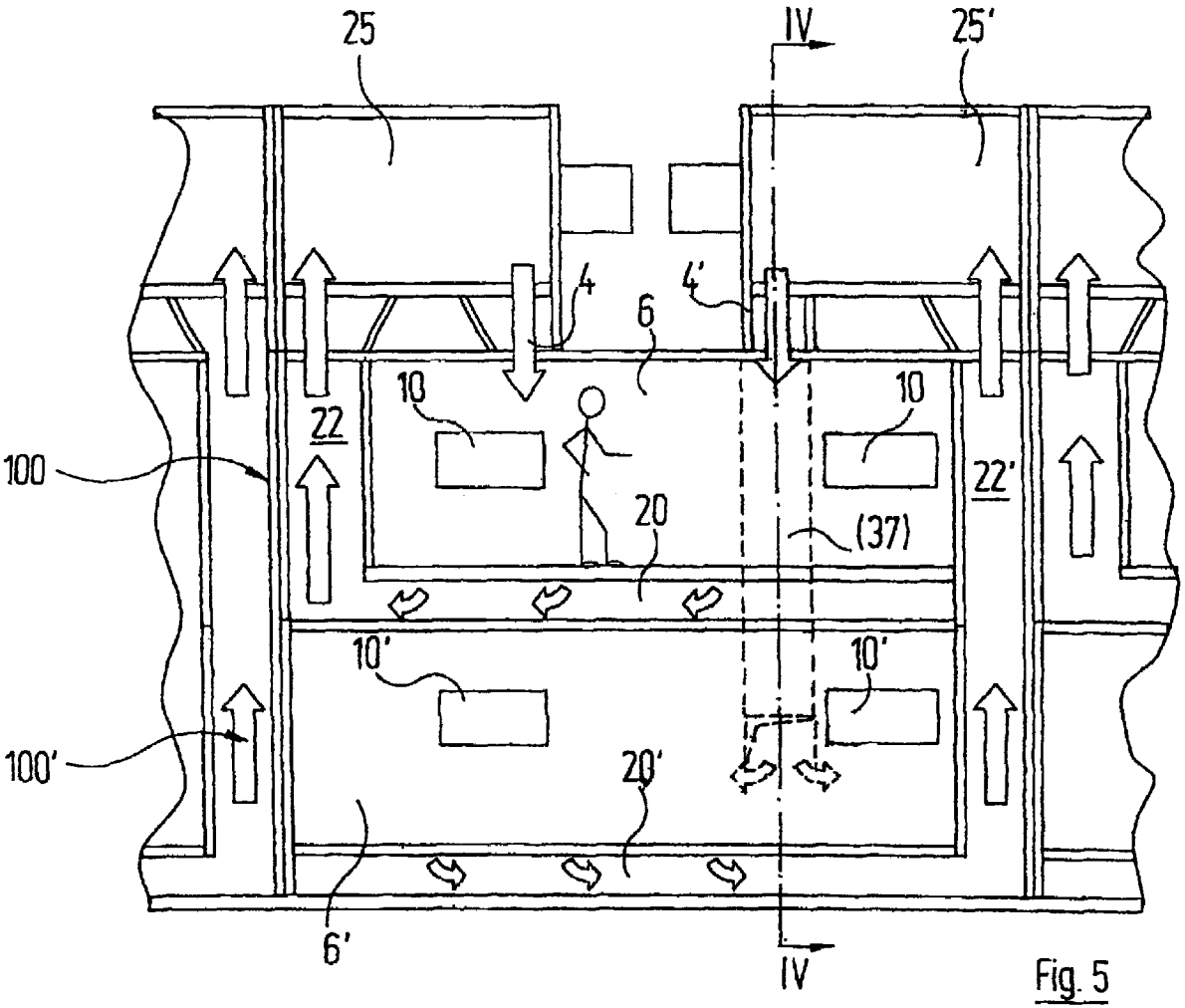
FIG. 5 shows a section according to line V-V of FIG. 4.

In the exemplary embodiment of FIGS. 4 and 5, completely independent operation of the two drying facilities 100, 100' lying one above the other is possible. What is meant by "independent operation" is that each of these drying facilities 100, 100' on its own or both drying facilities 100, 100' together can be run at identical or different air temperatures. For this purpose, the following changes are made compared with the exemplary embodiment of FIG. 3:

The air heated by the circulating-air heating unit 25' illustrated at the top on the right in FIG. 5 is not introduced directly into the respective pressure spaces 6' and 7' of the drying facility 100' situated in the lower "storey" but via connecting ducts 36, 37 attached laterally to the housing 1. As a result, the two drying facilities 100, 100' situated respectively in the upper and lower "storey" of the housing 1 are completely uncoupled from one another.

In the above description of FIGS. 1 to 5, it has been assumed that the apparatus illustrated is a drier in each case. However, the same design can also be employed for coolers; the only change which has to be made for this purpose consists in replacing the respective circulating-air heating units 25, 25' by cooling units. An apparatus designed as a cooler can, moreover, adjoin an apparatus functioning as a drier, in which case merely a short air lock or a similar device which separates the warmer atmosphere of the drier from the cool atmosphere of the cooler has to be provided between the two apparatuses.

Optionally, a cooling unit can also be completely dispensed with. In this case, fresh air can be blown into the pressure spaces 6, 7, 6', 7' of the cooler, this fresh air striking the objects 19, 19' to be cooled in the useful spaces 14, 14'. The air heated thereby is sucked out via the floor ducts 20, 21, 20', 21' and led via the vertical connecting conduits 22, 23, 22', 23', now serving as exhaust shafts, to a fan which conveys the air either into the atmosphere or else feeds it completely or partially to a following zone or other facilities.

If the fresh air is very cold, it may also be necessary in special cases, for the purpose of achieving a desired air temperature, to provide in the cooler a heating device which warms up the fresh air accordingly.

The invention claimed is:

1. An apparatus for thermally conditioning objects comprising;

a housing:

at least two thermally conditioning facilities arranged one above the other in the housing and substantially over the same floor area, each thermally conditioning facility comprising a tunnel shaped cavity in which objects present within the cavity can be impinged by a stream of thermally conditioned air, the cavity being arranged in parallel with a corresponding tunnel shaped cavity of each of the other thermally conditioning facilities, such that a stream of thermally conditioned air passing through the cavity of one of the at least two thermally conditioning facilities is prevented from also passing through the cavity of any one of the remaining thermally conditioning facilities, wherein an air path on which the thermally conditioned air flows to a first thermally conditioning facility leads through a second thermally conditioning facility, and a conveying system, by which the objects can be moved through the tunnel shaped cavity; and a device disposed in the air path by which the passage of thermally conditioned air from the second thermally conditioning facility into the first thermally conditioning facility can be selectively interrupted.

2. The apparatus according to claim 1, wherein the device for interrupting the air path is a controllable flap.

3. The apparatus according to claim 1, wherein the device for interrupting the air path is a closable louvre.

4. The apparatus according to claim 1, wherein the at least two thermally conditioning facilities at least regionally divide the air path on which the air is discharged from the tunnel shaped cavities.

5. The apparatus according to claim 1, wherein the apparatus is designed as a drier and has at least one heating unit for thermally conditioning the air.

6. The apparatus according to claim 5, wherein the same number of heating units are provided as there are thermally conditioning facilities.

7. An apparatus for thermally conditioning objects comprising:

a housing;

at least two thermally conditioning facilities arranged one above the other in the housing and substantially over the same floor area, each thermally conditioning facility comprising a tunnel shaped cavity in which objects present within the cavity can be impinged by a stream of thermally conditioned air, the cavity being arranged in parallel with a corresponding tunnel shaped cavity of each of the other thermally conditioning facilities, such that a stream of thermally conditioned air passing through the cavity of any one of the at least two thermally conditioning facilities is prevented from also passing through the cavity of any one of the remaining thermally conditioning facilities, and a conveying system, by which the objects can be moved through the tunnel shaped cavity; and wherein the air path on which the thermally conditioned air flows to the first thermally conditioning facility is independent of the air path on which the thermally conditioned air flows to the second thermally conditioning facility.

8. An apparatus for thermally conditioning objects comprising:

a housing;

at least two thermally conditioning facilities arranged one above the other in the housing and substantially over the same floor area, each thermally conditioning facility comprising a tunnel shaped cavity in which objects present within the cavity can be impinged by a stream of thermally conditioned air, the cavity being arranged in parallel with a corresponding tunnel shaped cavity of each of the other thermally conditioning facilities, such that a stream of thermally conditioned air passing through the cavity of any one of the at least two thermally conditioning facilities is prevented from also passing through the cavity of any one of the remaining thermally conditioning facilities, and a conveying system, by which the objects can be moved through the tunnel shaped cavity; and wherein the at least two thermally conditioning facilities are designed as coolers.

9. The apparatus according to claim 8, further comprising at least one fan, which sucks in fresh air and introduces it as thermally conditioned air into the tunnel shaped cavities of the at least two thermally conditioning facilities.

10. The apparatus according to claim 8, further comprising at least one cooling unit, which cools the air introduced into the tunnel shaped cavities of the at least two thermally conditioning facilities.

11. A thermal conditioning apparatus for circulating air about a workpiece present within the apparatus, the thermal conditioning apparatus comprising:

a first thermal conditioning chamber having a hollow cavity for receiving a first workpiece;

a second thermal conditioning chamber having a hollow cavity for receiving a second workpiece;

a first air inlet plenum for supplying a first stream of air to the first thermal conditioning chamber;

a second air inlet plenum for supplying a second stream of air to the second thermal conditioning chamber, the first air inlet plenum fluidly connected to the second inlet air plenum for allowing air from the first air inlet plenum to pass to the second air inlet plenum, wherein the first and second streams of air do not pass through a common thermal conditioning chamber; and a valve positioned between the first and second air inlet plenums for regulating an amount of air flowing from the first air inlet plenum to the second air inlet plenum.

12. The thermal conditioning apparatus according to claim 11, wherein the first thermal conditioning chamber is positioned above the second thermal conditioning chamber.

13. The thermal conditioning apparatus according to claim 11, wherein the second stream of air supplied by the second air inlet plenum to the second thermal conditioning chamber consists entirely of air delivered to the second air inlet plenum from the first air inlet plenum.

14. The thermal conditioning apparatus according to claim 11 further comprising an air discharge plenum for receiving the first stream of air discharged from the first thermal conditioning chamber and the second stream of air discharged from the second thermal conditioning chamber, wherein the first stream of air mixes with the second stream of air within the air discharge plenum.

15. A thermal conditioning apparatus for circulating air about a workpiece present within the apparatus, the thermal conditioning apparatus comprising:

a first thermal conditioning chamber having a hollow cavity for receiving a first workpiece;

a second thermal conditioning chamber having a hollow cavity for receiving a second workpiece;

a first air inlet plenum for supplying a first stream of air to the first thermal conditioning chamber;

a second air inlet plenum for supplying a second stream of air to the second thermal conditioning chamber, the first air inlet plenum fluidly connected to the second inlet air plenum for allowing air from the first air inlet plenum to pass to the second air inlet plenum, wherein the first and second streams of air do not pass through a common thermal conditioning chamber; and an air conditioning unit operable for selectively heating and cooling a stream of air, the air conditioning unit fluidly connected to the first air inlet plenum.

16. The thermal conditioning apparatus according to claim 15, wherein the air discharge plenum is fluidly connected to the air conditioning unit.

17. A thermal conditioning apparatus for circulating air about a workpiece present within the apparatus, the thermal conditioning apparatus comprising:

a first thermal conditioning chamber having a hollow cavity for receiving a first workpiece;

a second thermal conditioning chamber having a hollow cavity for receiving a second workpiece;

a first air inlet plenum for supplying a first stream of air to the first thermal conditioning chamber;

a second air inlet plenum for supplying a second stream of air to the second thermal conditioning chamber, the first air inlet plenum fluidly connected to the second inlet air plenum for allowing air from the first air inlet plenum to pass to the second air inlet plenum, wherein the first and second streams of air do not pass through a common thermal conditioning chamber;

at least two air conditioning units, each fluidly connected to the first air inlet plenum and operable for selectively heating and cooling a stream of air delivered to the first inlet air plenum; and at least one valve for regulating the amount of air passing between at least one of the air conditioning units and the first air inlet plenum.

* * * * *